United States Patent [19]

Beattie

[11] Patent Number: 4,852,280

[45] Date of Patent: Aug. 1, 1989

[54] GREETING CARD HOLDING AND DISPLAYING APPARATUS

[76] Inventor: Robert T. Beattie, 301 Trousdale Pl., Beverly Hills, Calif. 90210

[21] Appl. No.: 296,918

[22] Filed: Jan. 12, 1989

Related U.S. Application Data

[63] Continuation of Ser. No. 85,952, Aug. 17, 1987, abandoned.

[51] Int. Cl.[4] ..... G09F 1/10

[52] U.S. Cl. ..... 40/124

[58] Field of Search ..... 40/124, 124.2, 124.4, 40/642

[56] References Cited

U.S. PATENT DOCUMENTS

| | | | |
|---|---|---|---|
| 3,524,274 | 8/1970 | Glassburn | 40/124.4 |
| 3,524,275 | 8/1970 | Korth | 40/124.4 |
| 3,789,526 | 2/1974 | Lavinson | 40/124 |

*Primary Examiner*—Robert P. Swiatek
*Assistant Examiner*—Michael Lynch
*Attorney, Agent, or Firm*—Paul R. Wylie

[57] ABSTRACT

There is provided a greeting card holding and displaying apparatus which includes a central core member upon which a cord is wrapped in successive loops lengthwise. Greeting cards are inserted under individual strands of the cord for display.

2 Claims, 1 Drawing Sheet

GREETING CARD HOLDING AND DISPLAYING APPARATUS

This is a continuation of co-pending application Ser. No. 085,952 filed on Aug. 17, 1987, now abandoned.

This invention relates generally to an apparatus for holding and displaying greeting cards. Typically, the apparatus of the invention can be used by a recipient of greeting cards, such as holiday greeting cards, birthday cards, and get well cards, and other occasions and celebrations to hold and display the cards in a manner such that the cards can be easily seen and read.

BACKGROUND OF THE INVENTION

Many recipients of greeting cards desire to keep the cards and display them for their own future viewing or for the viewing of others. Common techniques for such displays have been attaching the cards to walls and displaying the cards on tables either in a tented manner where the cards stand upright or by laying them flat.

Other, more inventive techniques for displaying greeting cards are represented in prior art patents including those U.S. Pat. Nos. 3,144,944 to Cunitaro Niino; C.H. Hazelton, 2,447,856; E. Glassburn, 3,524,274; P.V. Korth, 3,524,275; Theodore S. Lappo, 3,599,360 and Barry M. Lavinson, 3,789,526. These patents generally tend to show a number of methods used in the prior art for holding and displaying greeting cards. By comparison to this invention, these prior art attempts have generally produced bulky, unsightly and costly apparatus that is both obtrusive and complicated mechanically. Moreover, the prior art apparatus are generally for store display and not for use by card recipients.

In particular, prior art U.S. Pat. No. 3,789,526, utilizes a cord strung cylinder which requires a series of protuberances to hold the cord in spaced relationship with the surface of the body member. Cards inserted under these cords would not be held tightly against the body member and would be permitted to slip in the space provided resulting in skewing or damaging the card if a user sought to open the card while it was in place on the cord.

SUMMARY OF THE INVENTION

According to this invention there is provided a greeting card holding and displaying apparatus which includes a central core member upon which cord means are wrapped in successive loops lengthwise. Said cord means are sufficiently taut to prevent sagging, but are sufficiently outwardly flexible to permit the easy insertion of cards under the individual strands thereof.

In a preferred embodiment of the invention, the individual strands of the cord are adjacent to each other to substantially cover the surface of the core member to present an aesthetically pleasing cord covered core member. The core member can be a hollow cylinder. In a further preferred embodiment, the cord means can be a continuous strand of yarn.

A feature of the invention is the provision of a core member having a height at least equal to the height of the usual greeting cards, and in some cases extending therebeyond. The base of the core member is capable of providing stable resting support on a planar surface, such as a table, and has at least three points in a plane to permit such stable resting support. In a preferred embodiment thereof, the ratio of the height of the core member to the distance between such points is in the range of about 1.5 to 1 to about 2.5 to 1.

It was an object of this invention to provide an aesthetically pleasing greeting card holding and displaying apparatus that would exhibit the minimum mechanical detail and would otherwise be unobtrusive.

A further object of this invention was the provision of an apparatus of the foregoing type which would hold and display a great number of cards for the ready viewing of those interested in them.

A still further object was the provision of a card holder and displaying device where the cards would remain open for full viewing.

Yet another object of this invention was the provision of the foregoing apparatus which would rest solidly on a table top without tipping due to the weight of cards, or by accidental impact from persons or things. These and other objects will be apparent from the accompanying drawings, illustrating the invention, wherein.

DETAILED DESCRIPTION

Figure 1:
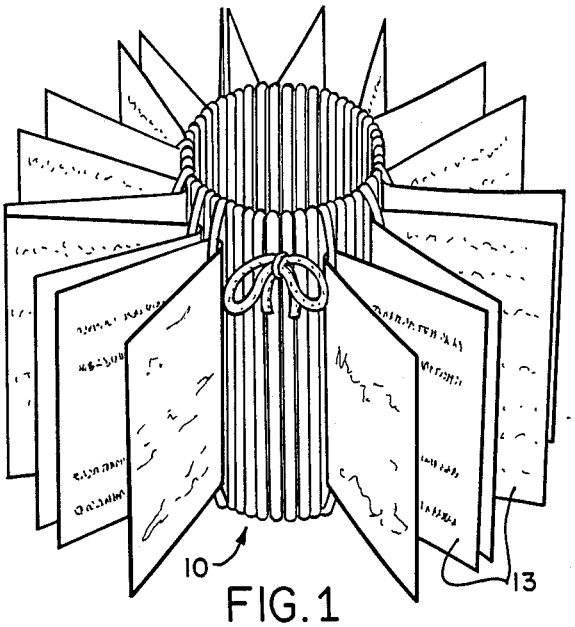
FIG. 1 is a perspective view of a greeting card holding and displaying apparatus according to a preferred embodiment of the invention showing greeting cards displayed thereon.
Figure 2:
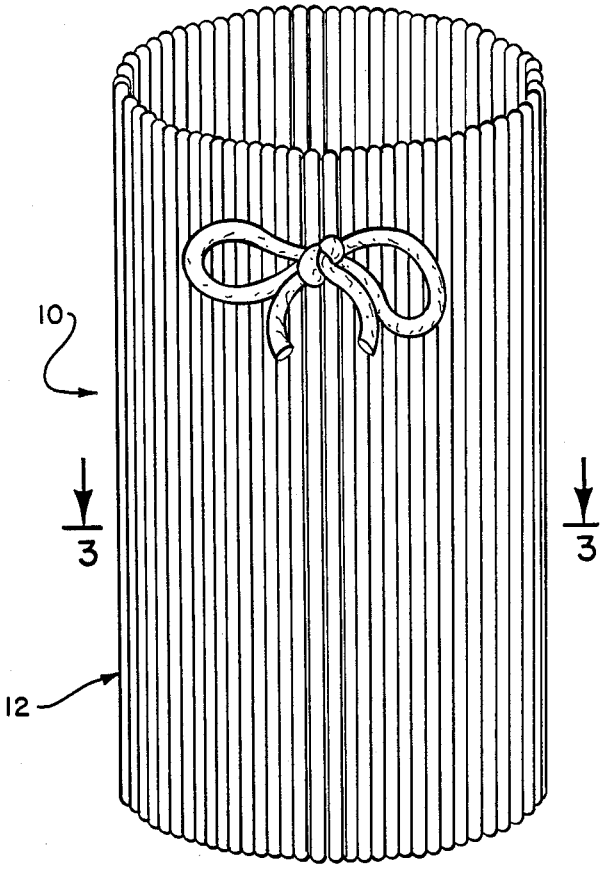
FIG. 2 is an enlarged view in perspective of the apparatus of FIG. 1.
Figure 3:
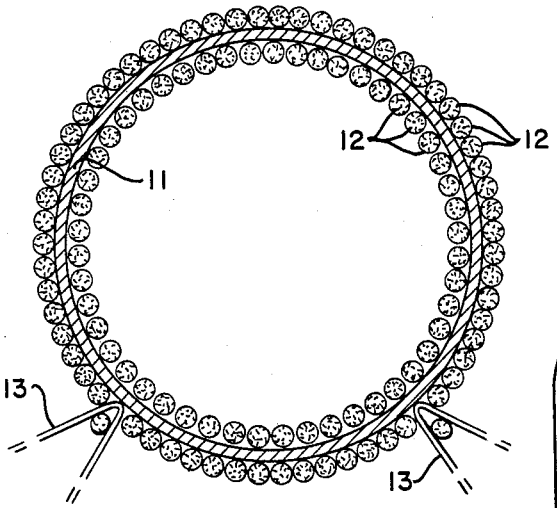
FIG. 3 is a view and cross section taken on line 3—3 of FIG. 2.
Figure 4:
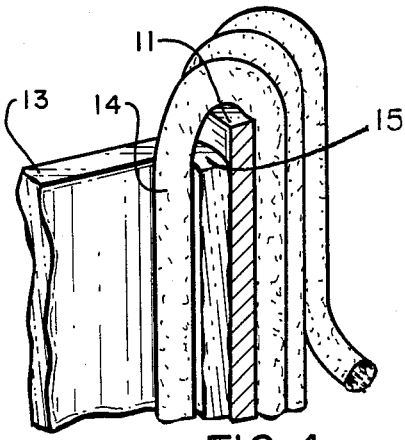
FIG. 4 is a fragmentary sectional view of the apparatus of FIG. 1 showing details thereof; and, FIG. 5 is an enlarged fragmentary view of the apparatus of FIG. 1 showing further details thereof.
Figure 5:
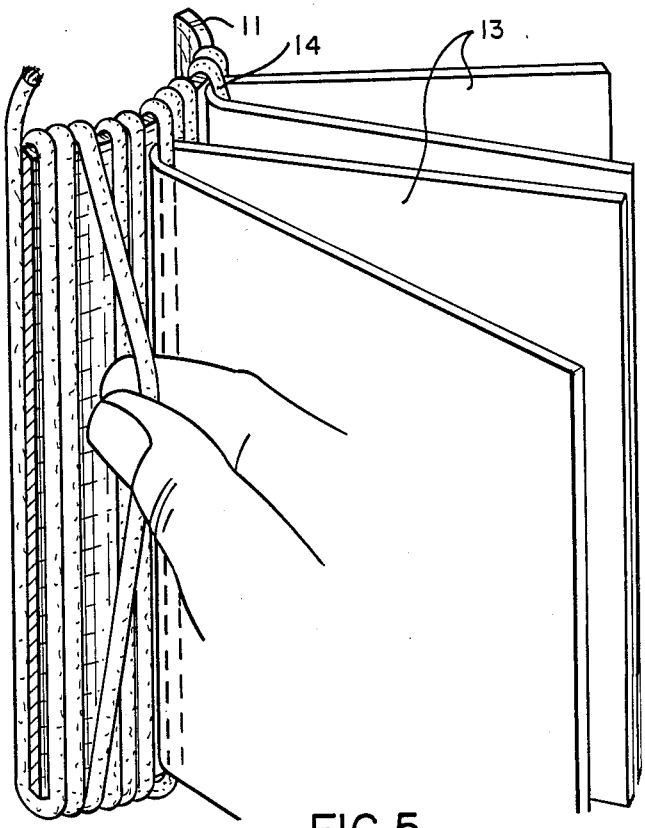

Referring now to the drawings there is shown a greeting card holding and displaying apparatus 10. Such apparatus consists of a core member 11 and cord means 12, which comprises a cord wrapped in successive loops lengthwise of core means 11.

As shown in the drawings a greeting card 13 is inserted under a strand 14 of cord means 12. The greeting card 13 is inserted with its spine 15 lying parallel and adjacent to strand 14.

While the number of strands 14 of cord means 12 will depend upon the weight of the cord, in the configuration shown, it is preferred to have from about 4 to about 16 strands per inch of circumference.

Cord means 12 can be formed of continuous strands of string, rope or yarn, of which yarn is preferred. A preferred yarn will add little or no elasticity so that it can be wound tightly around the inside and outside of the core member 11 from the top to the bottom and on the surface of the core. After winding, the yarn is preferred to cover substantially the entire outer periphery of the core member to provide the maximum number of individual strands 14 for the card holding and display according to the invention. Close winding of the strands 14 with each strand immediately adjacent and/or touching or overlapping the strand next to it provides the foregoing advantages as well as providing aesthetics to the apparatus. If yarn is used, a multiple colored appearance can be obtained by using either multiple colored yarn or strands of different colors. The yarn is secured by tying ends of the yarn together or by other suitable attachment means which may involve attachment to the core member 11.

While a cylindrical core member 11 is preferred, such core member can also be of round, square, oblong, triangular or other cross sectional configuration according to the principles of the invention as long as the aforementioned stable resting support is obtained. In this regard, in the preferred embodiment, the ratio of the height of said core member 11 to the distance between the points on the base of said core member which supply stable resting support on a planar surface is in the range of about 1.5 to 1 to about 2.5 to 1.

The core member 11 can be formed of suitable materials such as metal, ceramic, plastic or wood materials such as cardboard or fiber products.It is preferred to utilize a laminated cylindrical kraft paper core member of two to five ply thickness or more with four plys being currently preferred. The strength of such core member is enhanced by cord means 12 serving as a structural reinforcement.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A greeting card holding and displaying apparatus comprising;

(a) A central hollow cylindrical core member having an inside surface and an outside surface, said core member being of a height at least equal to the height of the greeting cards to be held and displayed thereon, the base of said core member having at least three points in a planar surface to permit stable resting support of the core member upon a planar surface; and, (b) cord means of a continuous strand being wrapped in successive loops lengthwise of said hollow cylindrical core and flush against the inside and outside surfaces of said hollow cylindrical core member to cover the core surfaces, said cord means being operative to permit the easy insertion of cards under individual strands thereof and, being taut to prevent sagging to the cord means due to the weight of the cards and individual strands of said cord means being adjacent to each other to cover the inside surface and the outside surface of said core member.

2. The apparatus according to claim 1 wherein the ratio of the height of said core member to the distance between the points to supply stable resting support is in the range of about 1.5 to 1 to about 2.5 to 1.

* * * * *